United States Patent [19]

Lonati

[11] Patent Number: 4,773,237

[45] Date of Patent: Sep. 27, 1988

[54] CONTROL DEVICE FOR THE PNEUMATIC PRODUCT TENSIONING AND TRANSPORT CIRCUIT IN CIRCULAR KNITTING MACHINES FOR STOCKINGS AND THE LIKE

[75] Inventor: Francesco Lonati, Brescia, Italy

[73] Assignee: Lonati SpA, Brescia, Italy

[21] Appl. No.: 916,905

[22] Filed: Oct. 7, 1986

[30] Foreign Application Priority Data

Oct. 14, 1985 [IT] Italy ..... 22478 A/85

[51] Int. Cl.[4] ..... D04B 15/88

[52] U.S. Cl. ..... 66/149 S

[58] Field of Search ..... 66/149 S, 153; 223/43; 406/10, 11, 183, 192

[56] References Cited

U.S. PATENT DOCUMENTS 3,063,275 11/1962 Luchi ..... 66/149 S
3,282,531 11/1966 Stewart ..... 406/10 X
3,738,123 6/1973 Mazzi ..... 66/149 S
3,841,112 10/1974 Uhlir et al. ..... 66/149 S X
4,541,351 9/1985 Horita et al. ..... 223/43 X
4,576,019 3/1986 Keel et al. ..... 66/149 S X

FOREIGN PATENT DOCUMENTS 471865 2/1929 Fed. Rep. of Germany ..... 403/183
1055701 1/1967 United Kingdom ..... 66/149 S

*Primary Examiner*—Ronald Feldbaum
*Attorney, Agent, or Firm*—Guido Modiano; Albert Josif

[57] ABSTRACT

The control device comprises a switching valve acting on the pneumatic circuit for passing from a first tensioning phase to a second transport phase and vice versa, and a step motor operated by an electronic machine control member and operatively connected to the cutoff element of the switching valve. The step motor allows to perform, according to a preset program, the passage from the first phase to the second phase and vice versa, and to achieve, at least in the first phase, a choking of the flow which crosses the switching valve to adjust the tension to which the product is subject.

2 Claims, 1 Drawing Sheet

CONTROL DEVICE FOR THE PNEUMATIC PRODUCT TENSIONING AND TRANSPORT CIRCUIT IN CIRCULAR KNITTING MACHINES FOR STOCKINGS AND THE LIKE

BACKGROUND OF THE INVENTION

The present invention relates to a control device for the pneumatic product tensioning and transport circuit in circular knitting machines for stockings and the like.

In circular machines for stockings, pneumatic circuits have been employed for some time to provide the tensioning of the stocking during the processing and to provide the transport thereof with its expulsion at the end of the processing.

These pneumatic circuits are composed of an aspiration chamber placed below the needle-bearing cylinder and connected through a conveyance conduit to an expulsion bell which in turn is connected to an aspirator. By operating the aspirator, a depression occurs in the aspiration chamber, which obtains the tensioning of the stocking during its forming and which allows, at the end of the processing, its transport up to the expulsion bell.

In the case of very long products, the disadvantage occurred of the twisting of the stocking during its formation and, for this reason, a device commonly known as anti-twist has been fitted in the aspiration chamber and the pneumatic circuit has been modified.

More in detail, a drilled pipe has been introduced into the aspiration chamber, which pipe rotates with the needlebearing cylinder, within which the stocking descends during its formation. By connecting the aspirator with the aspiration chamber as well as with the expulsion bell, and by placing a switching valve on the connecting conduits, according to the operation of the valve a first phase is obtained in which the aspirator is connected directly to the aspiration chamber so as to tension the stocking, which is held against the internal walls of the drilled pipe, and a second phase in which the aspirator is connected to the aspiration chamber through the transport conduit so as to suck the stocking at the end of the processing, transporting it out of the machine.

Generally, the switching from the first to second phase is obtained by means of cam profiles carried by a machine programing cylinder which, at the end of the processing of the stocking, by means of a system of leverages, acts on the cutoff element of the switching valve, varying the connection of the aspirator and which, after the start of a new processing, reestablishes the previous connection.

These known kinds of devices, though they achieve the tensioning of the stocking during the processing and provide its expulsion from the machine when processing is complete, have some disadvantages.

Among these, one of the main disadvantages is due to the fact that, between the programing cylinder and the switching valve, there is a series of mechanical transmissions which make the entire device very cumbersome and complicate its assembly, its tuning and its maintenance.

Another disadvantage is due to the fact that, every time the type of thread or of processing is changed, it is necessary to calibrate the valve manually so as to achieve during the tensioning phase a correct choking of the flow to increase or decrease the tensioning of the stocking during processing.

SUMMARY OF THE INVENTION

The main aim of the present invention is to eliminate the above described disadvantages by providing a control device for the pneumatic product tensioning and transport circuit, which allows a greater speed in assembly, tuning and maintenance.

Within the scope of the above described aim, an object is to provide a control device which can automatically vary the degree of tensioning of the stocking according to the thread and to the kind of processing being performed.

This aim, as well as this and other objects which will become apparent hereinafter, are achieved by a control device for the pneumatic product tensioning and transport circuit of circular knitting machines for stockings and the like, comprising: a switching valve acting on the pneumatic circuit for passing from a first tensioning phase to a second transport phase and vice versa, and a step motor operated by an electronic machine control apparatus and operatively connected to the cutoff element of said switching valve, to provide the passage from said first phase to said second phase and vice versa, with, at least in the first phase, a choking of the pneumatic flow to adjust the tension to which the product is subject.

BRIEF DESCRIPTION OF THE DRAWINGS

Further characteristics and advantages of the invention will become apparent from the detailed description of a preferred, but not exclusive, embodiment of the device according to the invention, illustrated by way of non-limitative example in the accompanying drawings, where.

DESCRIPTION OF THE PREFERRED EMBODIMENTS

Figure 1:
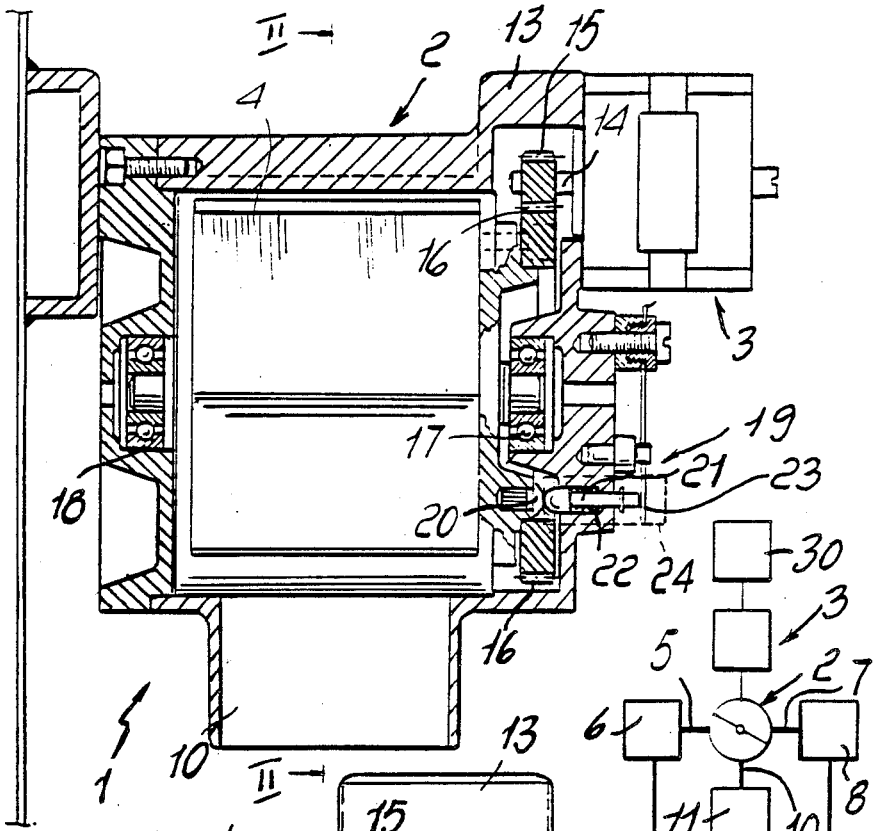
FIG. 1 is a partly cutout lateral elevation view of the device according to the invention.

With reference to the figures, the device according to the invention, designated generally with the reference numeral 1, comprises a switching valve 2 and a step motor 3 which controls the operation of the former.

The switching valve 2 is essentially composed of a valve body with a cylinder cavity **2*a* having an axis 2*b* and defining a three-way valve wherein a rotatable butterfly cutoff element 4 is moved to provide the connection between two of these ways. More in detail, the valve 2 is endowed with two inlets, of which: a first inlet 5 which comprises an aperture and a duct is connected with the aspiration chamber 6, possibly endowed with an anti-twist device, placed below the needle-bearing cylinder; a second inlet 7 which likewise comprises an aperture and a duct is connected with the expulsion bell 8 which, through a bypassing transport conduit 9, is in turn connected with the aspiration chamber 6; a third inlet 10, likewise comprising an aperture and a duct is connected with an aspirator 11**.

Figure 3:
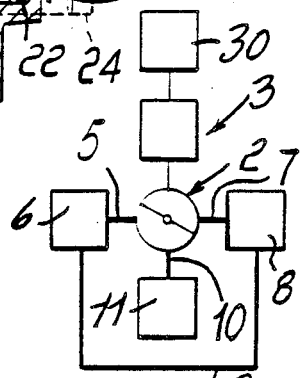
FIG. 3 is a simplified diagram to illustrate the connections of the device according to the invention in a circular knitting machine for stockings.
Figure 2:
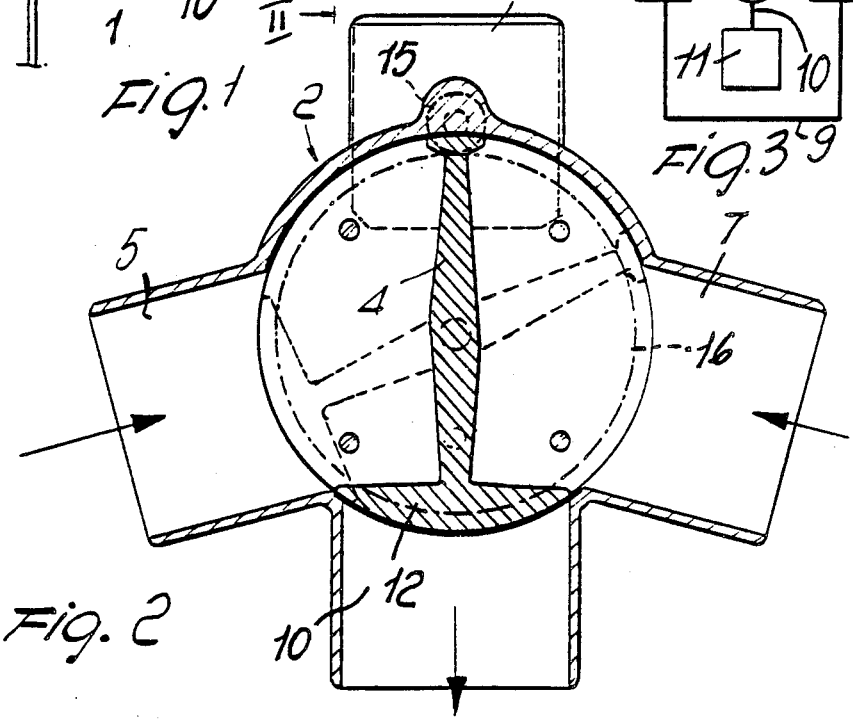
FIG. 2 is a cross section of FIG. 1 along the axis II—II.

The blade-like cutoff element 4 has an axis of rotation coaxial with the axis of the cylindrical cavity and is shaped so that it selectively allows, in a first position thereof shown in FIG. 3, connection of the third inlet with the first or in a second position thereof shown in dotted lines in FIG. 2, with the second inlet and has, proximate to an end thereof, an expansion 12 to obstruct, in an intermediate position shown in full lines in FIG. 2 and intermediate between the first and the second position thereof, the third inlet 10.

As visible from the drawing the cutoff element 4 is diametrically arranged in the cylindrical cavity of the valve body and its expansion 12 has a dimension corresponding to the cross-sectional area of the apertures 5, 7 and 10.

The step motor, of a known kind, is connected to a programable electronic control member 30, more in detail a microprocessor, which controls the rotation of the step motor according to a preset program selectable according to the various processing requirements.

The step motor is associated with the body 13 of the valve and, on the output shaft 14, carries a toothed pinion 15 which meshes with a toothed wheel or rim 16 rigidly coupled with the cutoff element 4 of the valve.

The toothed wheel 16 is arranged coaxially with the axis of rotation of the cutoff element which is mounted on two bearings 17 and 18.

The device according to the invention is furthermore provided with a reset device 19 connected with the control apparatus of the machine and substantially composed of a switch 24 mounted on the valve body, which can be operated by an abutment 20 rigidly coupled with the cutoff element in a preset position.

The switch is composed of a first contact element in the form of a small shaft 21, slideable against the biasing action of a spring 22 to touch with an outwardly projecting end thereof a second contact element in the form of a plate 23 connected to the control apparatus.

The abutment 20 is mounted on the rotating cutoff element so as follow, during rotation of cutoff element, a circular path interferring with the opposite end of shaft 21 so as to strike the shaft 21 and push it into contact with the plate 23 thus closing the switch 24 when the cutoff element is in a preset angular position memorized in the control apparatus as a zero position.

After what has been described, the operation of the control device according to the invention is clear.

At the beginning of every kind of processing, the operator selects the type of program to be run by the knitting machine M diagrammatically shown in FIG. 3 and the control apparatus 30 resets the position of the cutoff element 4 of the switching valve by acting on the step motor. When the cutoff element has reached its zero position, the abutment 20 strikes the small shaft 21, which in turn contacts the plate 23, which signals to the control apparatus that a reset has been performed. At this point the processing of the stocking begins, and the control apparatus actuates the step motor 3 which, through the pinion 15 and the toothed wheel 16, acts on the cutoff element 4 so as to connect the third inlet 10 with the first inlet 5 diagrammatically shown in FIG. 3, or so as to connect the aspirator 11 to the aspiration chamber 6 to achieve the tensioning of the stocking being formed with the actuation of the anti-twist device, if any.

In this phase, the programming apparatus, according to the processing program, chokes by means of the expansion 12 by the required amount the aspiration flow, by positioning the expansion 12 to partially open by a preset amount the third inlet so as to obtain the tensioning of the stocking which is most suitable for the processing in progress.

When the formation of the stocking is complete, the control apparatus acts on the step motor which in turn rotates the cutoff element placing the third inlet 10 in communication with the second inlet 7 as shown in dotted lines in FIG. 2, or connecting the aspirator to the expulsion bell 8. In this manner the stocking is sucked by the expulsion bell through the transport conduit 9 and is expelled in a known manner. Naturally, it is possible to choke the flow also during the transportation phase, according to the requirements. After the expulsion of the stocking, the cycle restarts.

In practice, it has been observed that the device according to the invention fully achieves the intended aim, not requiring the use of complex leverages nor any calibration at the beginning of a new type of processing.

Another advantage, due to the absence of transmission levers, is that there is no need for maintenance to recover any play due to wear.

A further advantage is that the connections between the switching valve and the control apparatus are effected with minimally bulky electric wires.

Not least advantage is to allow the simple connection of more than one machine to a single general control unit in the case of large industries.

The invention thus conceived is susceptible of numerous modifications and variations, all of which are within the scope of the inventive concept; furthermore, all the details can be replaced by technically equivalent elements.

Practically, any materials and dimensions, may be employed according to the requirements and the state of the art.

What is claimed is:

1. In a pneumatic circuit for tensioning and transporting knitting product produced by a circular knitting machine, in which the pneumatic circuit comprises an aspiration chamber, an expulsion bell at a distance from said aspiration chamber, an aspirator and a switching valve between said aspirator and said aspiration chamber and said expulsion bell, and first duct means pneumatically connecting said switching valve with said aspiration chamber, second duct means pneumatically connecting said switching valve with said expulsion bell, third duct means pneumatically connecting said switching valve with said aspirator and by-pass duct means pneumatically connecting said aspiration chamber and said expulsion bell in by-passing relationship with regard to said switching valve, a control device for controlling the flow of aeriform media through said pneumatic circuit, said control device comprising, a valve body of said switching valve including wall means defining a cylindrical cavity having a cylinder axis, a first aperture in said wall means and opening into said first duct means, a second aperture in said wall means and opening into said second duct means and a third aperture in said wall means and opening into said third duct means, a rotatable blade-like cutoff element diametrically arranged within said cylindrical cavity and having an axis of rotation coaxial with said cylinder axis, bearing means in said wall means of said valve body and adapted to rotatably support said cutoff element, a toothed rim rigid with said cutoff element and coaxial with said axis of rotation thereof, an intercepting expansion formation on one radial end of said cutoff element, said expansion formation having dimensions corresponding to the area of each of said first and third apertures adapted to progressively close alternatively said first and said third aperture from a partial closing choking respective relationship therewith to a total closing respective relationship therewith said cutoff element alternatively allowing or preventing fluid flow through said second aperture, a step motor having a pinon gear in transmissive engagement with said toothed rim of said cutoff element to selectively rotate over a desired angle of rotation said cutoff element upon actuation of said step motor, and a programmable electronic microprocessor member for controlling actuation of said step motor means.

2. A device according to claim 1, further comprising a reset device for controlling the angular position of said cutoff device, said reset device comprising a first contact element consisting of a spring biased shaft slidably supported on said valve body to project with one end thereof outwardly therefrom and having a second opposite abutment end thereof, a second contact element consisting of a plate facing said one projecting end of said shaft and connected with said microprocessor and an abutment formation rigid with said cutoff element and located in a preestablished angular position thereof defining a circular path thereof during rotation of said cutoff element, said circular path interferring with said second abutment end of said shaft, thereby to push said shaft into contact with said plate when said abutment formation engages said second abutment end.

* * * * *